US006325371B1

(12) United States Patent
Araki et al.

(10) Patent No.: US 6,325,371 B1
(45) Date of Patent: Dec. 4, 2001

(54) SHEET CONVEYING APPARATUS WITH CONVEYING PATH CHANGING DEVICE AND SORTER

(75) Inventors: Tomoyuki Araki, Numazu; Teruo Komatsu, Mishima; Yasuyoshi Hayakawa, Mishima; Tsuyoshi Waragai, Mishima; Atsushi Ogata; Masayoshi Fukatsu, both of Shizuoka-ken, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/386,171

(22) Filed: Aug. 31, 1999

(30) Foreign Application Priority Data

Sep. 1, 1998 (JP) ..... 10-247085

(51) Int. Cl.[7] ..... B65H 39/10
(52) U.S. Cl. ..... 271/297; 271/305; 270/58.22
(58) Field of Search ..... 271/303, 305, 271/297, 265.01; 209/534, 547, 554, 562; 270/58.18, 58.22

(56) References Cited

U.S. PATENT DOCUMENTS 4,026,540 * 5/1977 Lawrence ..... 271/173 X
4,494,748 * 1/1985 Miyashita et al. ..... 271/288 X
5,104,118 * 4/1992 Hamanaka ..... 271/297
5,115,281 5/1992 Ohtsuka et al. ..... 355/319
5,154,411 10/1992 Saito et al. ..... 271/289
5,155,537 10/1992 Komatsu et al. ..... 355/309
5,292,116 3/1994 Inoue et al. ..... 271/157
5,348,284 9/1994 Ishihama et al. ..... 271/160
5,501,444 3/1996 Yukimachi et al. ..... 271/127
5,788,229 * 8/1998 Asami et al. ..... 271/305
6,098,978 * 8/2000 Bielefeld et al. ..... 271/225 X

* cited by examiner

*Primary Examiner*—Christopher P. Ellis
*Assistant Examiner*—Kenneth W. Bower
(74) *Attorney, Agent, or Firm*—Fitzpatrick, Cella, Harper & Scinto

(57) ABSTRACT

A sheet conveying apparatus including a conveying path changing device, the conveying path changing device having a main conveying path for conveying a sheet, a plurality of branched paths branched from the main conveying path, a plurality of oscillatable flappers for selecting between a changed position where the sheet is guided from the main conveying path to one of the branched paths and a retracted position permitting passage of the sheet, a single solenoid for oscillating the plurality of flappers, a single link for connecting the solenoid and the flappers, and a sensor confirming movements of the flapper by detecting a movement of the link.

22 Claims, 8 Drawing Sheets

SHEET CONVEYING APPARATUS WITH CONVEYING PATH CHANGING DEVICE AND SORTER

BACKGROUND OF THE INVENTION

1. Field of the Invention

The present invention relates to a sheet conveying apparatus with a conveying path changing means and a sorter, and more particularly it relates to a sheet treating apparatus (sorter) having a function for sorting voluntarily and conveying sheets into a plurality of trays and an image forming apparatus.

2. Related Background Art

Recently, in image forming apparatuses such as copying machines, printers, facsimiles and the like, a sheet treating apparatus in which sheets are fed to the image forming apparatus and/or sheets on which image were recorded are sorted voluntarily into a plurality of trays and discharged or stapled has been used.

Such a technique was devised for the reason that, in an image forming apparatus such as a network printer which are used by plural persons, if a large number of sheets on which image were recorded are discharged onto a single tray, since it is difficult to discriminate who requires respective sheets in a sheet bundle discharged and stacked on the tray, the imaged sheets can be voluntarily sorted into a plurality of trays to assort respective documents. Among such conventional sheet treating apparatuses, for example, there is a sorter device in which sheets conveyed from a main body of an image forming apparatus are received and the received sheets are voluntarily sorted into a plurality of discharge trays to stack the sheets on the trays while conveying the sheets through a common sheet conveying path (common conveying path). As is well known, such a sorter device is used to be connected to a middle speed or high speed copying machine for mainly copying the same document by plural parts or a large size printer for printing a large number of sheets.

More specifically, for example, there is a sheet treating apparatus (sorter) of type in which discharge trays are fixed. Such a sheet treating apparatus comprises a plurality of discharge trays, a convey guide in which a plural pairs of discharge rollers for discharging sheet onto respective discharge trays are fixed to a main body of the apparatus and which defines a common conveying path and defines branch paths for guiding the sheets from the common conveying path to areas where the respective pair of discharge rollers are disposed, changing means (changing flappers) for voluntarily switching a conveying direction of each sheet at brunch paths of the common conveying path, and solenoids for driving the changing flappers. By one of the plural flappers simultaneously driven by a single actuating means through connecting means and elastic members, each sheet is sorted and is guided to a desired tray. If the flapper used for sorting the sheet is a downstream flapper among the flappers simultaneously driven, since flappers upstream of the downstream flapper abut against the sheet being conveyed, the common conveying path is not blocked by the upstream flappers.

However, in the conventional sorter, there are many unstable factors such as the facts that the plurality of flappers are driven simultaneously, that the flappers are driven via the elastic members, and that there is a case in which some flappers abut against the sheet and a case in which no flappers abut against the sheet. Thus, there is need for providing means for completing the oscillating movements of the flappers reliably and for ensuring that the sheet is discharged on the desired tray.

SUMMARY OF THE INVENTION

The present invention aims to eliminate the above-mentioned conventional drawback and an object of the present invention is to provide a sheet conveying apparatus in which a sheet is reliably conveyed in a predetermined conveying path.

To achieve the above object, according to the present invention, there is provided a sheet conveying apparatus comprising oscillatable changing means for changing a conveying path, electromotive means for generating an actuating force for oscillating the changing means, and a detecting means for confirming a movement of the changing means.

The electromotive means and the changing means may be interconnected through connecting means, and the detecting means may detect a movement of the connecting means.

When a fact that the changing means is not operated correctly is detected by the detecting means, alarm may be emitted, or alarm may be emitted and the apparatus may be stopped.

The sheet conveying apparatus may comprise a main conveying path for conveying a sheet, a plurality of branched paths branched from the main conveying path, a plurality of oscillatable changing means for selecting between a switched position where a sheet is guided from the main conveying path to one of the branched paths and a retracted position for permitting passage of the sheet, single electromotive means for oscillating the plurality of changing means, single connecting means for connecting the electromotive means and the changing means, and detecting means for confirming a movement of the connecting means.

As mentioned above, according to the present invention, even if an erroneous changeover occurs, the alarm can be emitted to the user. Accordingly, for example, even if the sheet is discharged to any tray other than the desired tray, it is very unlikely that the sheet is left on the incorrect tray, and, even when the apparatus is used commonly by plural persons, any trouble does not occur.

Further, during manufacturing, unstable factors can easily be found, and, thus, an apparatus having no unstable factor, which increases reliability, can be presented to the user.

Since the plurality of connecting members are detected by the single detecting means, cost for detection can be minimized.

DETAILED DESCRIPTION OF THE PREFERRED EMBODIMENTS

[First Embodiment]

Figure 1:
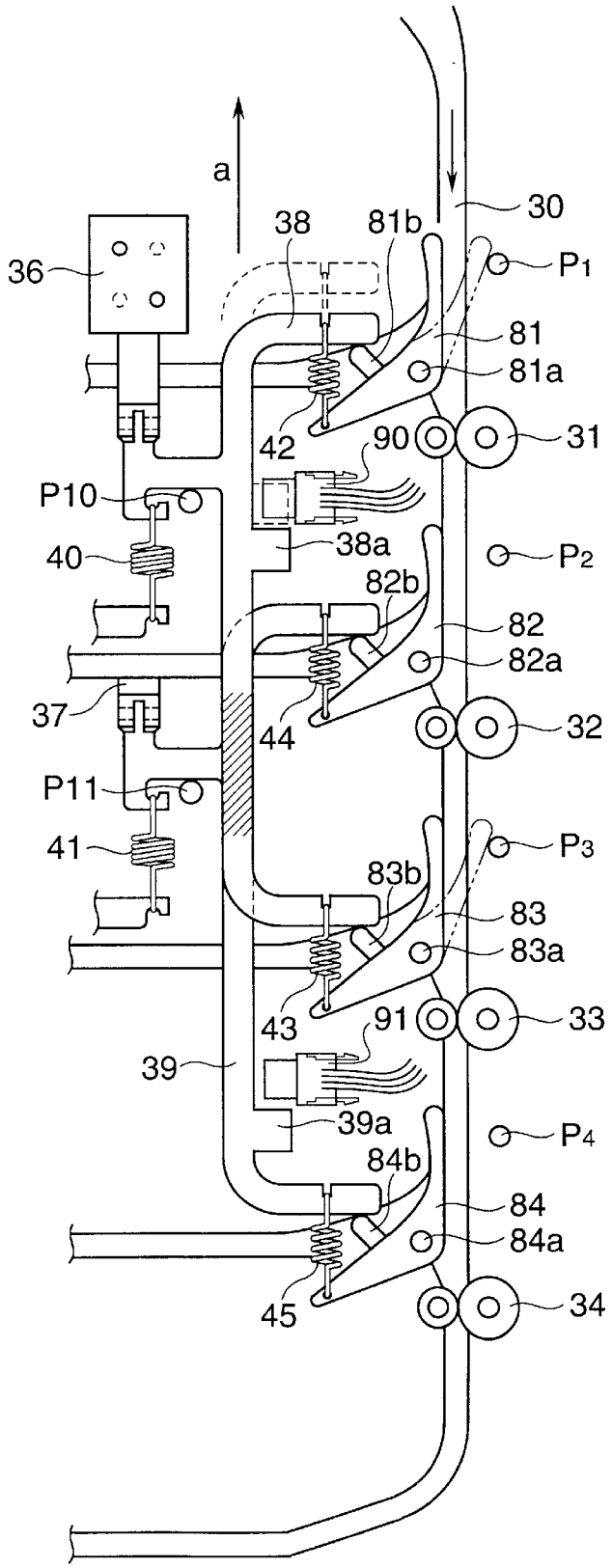
FIG. 1 is a view showing a condition that a sheet treating apparatus according to the present invention is connected to an image forming apparatus in parallel.

FIG. 1 is a sectional view of main parts of a sheet distributing apparatus according to an embodiment of the present invention.

In an image forming apparatus A (FIG. 6), when sheets on which images were formed are successively stacked with imaged surfaces facing upwardly, a stacking sequence (order) of the sheets will be reversed with respect to an image formation sequence (order). In order to correspond the stacking sequence to the image formation sequence, reversing of a front surface and a back surface of the sheet is effected through a switch-back path (having a forward and reverse rotatable roller 10) 11 to face the imaged surface downwardly. In this way, the sheet are discharged and stacked with the imaged surfaces facing downwardly.

Figure 6:
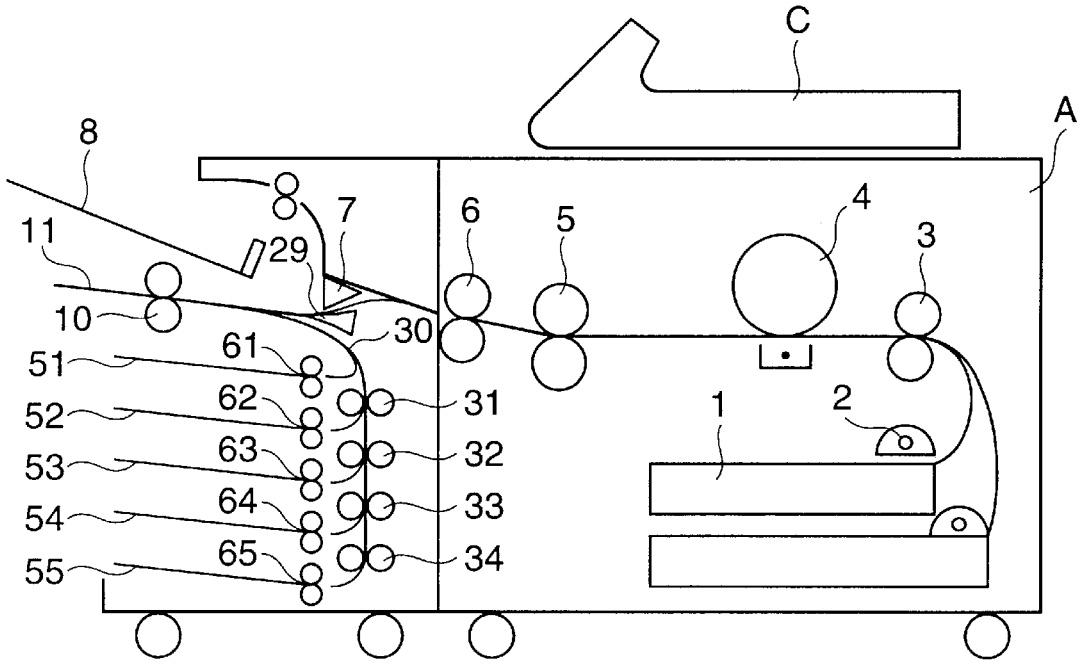
FIG. 6 is a front sectional view of an image forming apparatus having a sorter according to the present invention.

A flapper 29 serves to direct the switched-back sheet to a path 30 (FIG. 6).

When a series of reversing operations are finished, the sheet is directed to one of downstream face-down discharge ports 61 to 65 (discharging rollers) and are discharged through the port (61 to 65) with the imaged surfaces facing downwardly (face-down) (FIG. 6) and stacked on a corresponding tray (51 to 55).

Next, operations of flappers 81 to 84 in the sheet sorting will be explained. Solenoids 36, 37 as actuating means serve to selectively oscillate the flappers 81 to 84.

The solenoid 36 serves to oscillate the flappers 81, 83 and the solenoid 37 serves to oscillate the flappers 82, 84. Links 38, 39 as connecting means are connected to movable portions of the solenoids 36, 37 to be moved together with the movable portions, and the links 38, 39 are designed so that they can be moved only in an up-and-down direction in FIG. 1. Extension springs 40, 41 have one ends engaged with hook portions of the links 38, 39 and the other ends engaged with hook portions of a frame of the apparatus. There are provided extension springs 42 to 45 as elastic members. Among them, the extension springs 42, 43 connect between hook portions of the link 38 connected to the solenoid 36 and hook portions of the flappers 81, 83, and the extension springs 44, 45 connect between hook portions of the link 39 connected to the solenoid 37 and hook portions of the flappers 82, 84.

FIG. 1 shows a condition that the solenoids 36, 37 are turned OFF. In the condition that the solenoids 36, 37 are turned OFF, the links 38, 39 are lowered by tension forces of the extension springs 40, 41. In this case, the flappers 81 to 84 (first, second, third and fourth in order from the above) are located at positions (shown by the solid lines in FIG. 1) where the flappers have been rotated in anti-clockwise directions around shafts 81*a*, 82*a*, 83*a*, 84*a* not to block a common conveying path 30 as projections 81*b*, 82*b*, 83*b*, 84*b* formed in a non-sheet passing area are urged downwardly by ends of the links 38, 39 near the hooked portions. Here, for example, when the solenoid 36 (or solenoid 37) is turned ON, the link 38 (or 39) are pulled upwardly (in a direction shown by the arrow a), with the result that the flappers 81, 83 (or flappers 82, 84) are oscillated in clockwise directions by tension forces of the extension springs 42, 43 (or extension springs 44, 45), thereby the flappers are moved to positions (shown by the phantom lines in FIG. 1) where the common conveying path 30 is blocked by the flappers.

In this case, since detecting means 90 (or 91) is provided in a course of trajectory of the link 38 (or 39), a movement of a light blocking portion 38*a* (or 39*a*) of the link 38 (or 39) is detected by a photo-sensor as detecting means 90 (or 91), thereby confirming whether the operation of flapper is completed correctly.

Further, as mentioned above, by using the arrangement in which the plurality (two) of flappers are operated by the single solenoid, when the sheet is guided toward the discharging rollers by the third and fourth flappers 83, 84, the first and second flappers 81, 82 rub against the sheet. In the illustrated embodiment, it is designed so that pairs of conveying rollers 31 to 34 have conveying forces sufficiently greater than such rubbing resistance.

The flappers 81 to 84 are connected via the elastic members to the links 38, 39 connected to the solenoids 36, 37, and the plurality of flappers are operated by the single solenoid. If opening/closing of the flapper is not completed within a predetermined time period, the sheet is discharged onto any tray other than the tray designated by the user. Therefore, new limitation is added after the oscillation was started and till oscillation of the flappers is completed, in comparison with a case where a single flapper is oscillated.

Explaining more specifically, in a case where a third (from the above) tray 53 is designated, when the solenoid (actuating means) 36 is driven to try to guide the sheet by the flapper 83, if the oscillating operation of the flappers occurs earlier than the timing of the conveyance of the sheet, since the upstream flapper 81 is opened, the sheet being conveyed will be deflected by such upstream flapper 81 to be discharged onto the upstream tray other than the tray designated by the user. Accordingly, since the operation of the solenoid 36 must be effected after the leading end of the sheet passes through the flapper 81 and before the leading end reaches the flapper 83, the control of the solenoid is very difficult.

However, in the illustrated embodiment of the present invention, the detecting means 90, 91 are provided in the courses of trajectories of the connecting members managing the oscillating operations of the plurality of flappers, respectively. Thus, since the drive control of the actuating means can be altered on the basis of a detection signal from the detecting means, the control of the flappers can be facilitated.

Firstly, since the accuracy of opening/closing timing of the flappers is improved, it is very unlikely that the sheet is discharged onto any tray other than the designated tray, thereby enhancing the reliability.

Secondly, when the flappers, connecting members and actuating means are stopped at the first position (conveying path changing (branching) position shown by the phantom line in FIG. 1) and the second position (common conveying path forming position shown by the solid line in FIG. 1), impact noise against abutment stoppers can be suppressed.

Figures 2A, 2B:
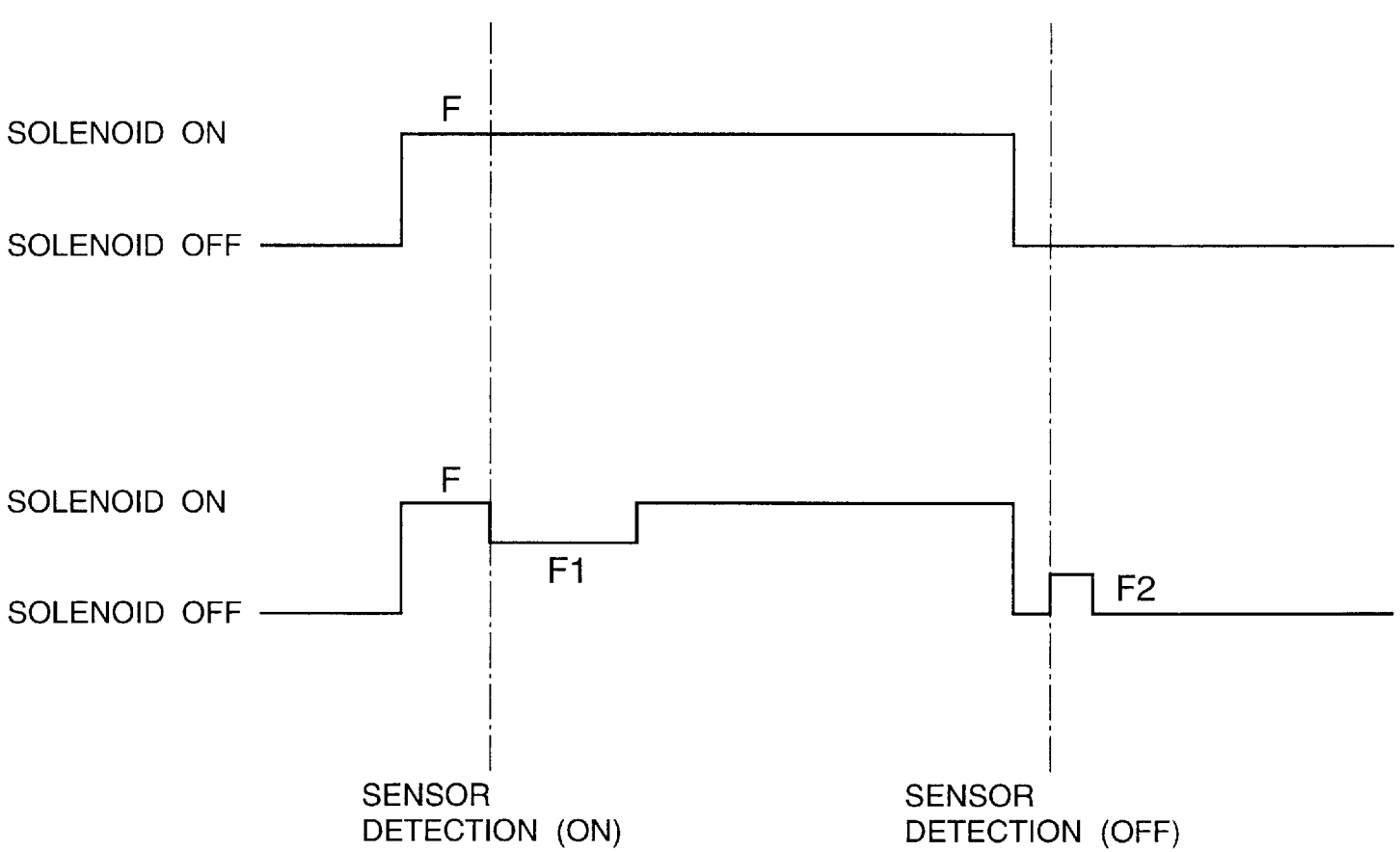
FIGS. 2A and 2B are views for explaining drive control of an actuating means.

FIG. 2A is a chart showing control of the conventional actuating means, and FIG. 2B is a chart showing control according to the illustrated embodiment. In the illustrated embodiment, as shown in FIG. 2B, after the solenoid (actuating means) 36 (or 37) is turned ON, when the movement of the link 38 (or 39) is detected by the detecting means 90 (or 91), the actuating force of the solenoid 36 (or 37) is temporarily changed from F to F1 (<F) on the basis of the detection signal from the detection means before the flappers abut against the abutment stoppers ($P_1$, $P_3$ or $P_2$, $P_4$) and until the abutment is completed. That is to say, before the flappers strike against the abutment stoppers, the actuating speeds of the flappers and the links are decreased to suppress the impact noise.

Then, after the guide of the sheet to the designated tray is finished and after the solenoid (actuating means) is turned OFF, on the way that the connecting member is returned to its home position, the movement of the link 38 (or 39) is detected again by the detecting means 90 (or 91).

Upon receiving such detection signal, the solenoid (actuating means) 36 (or 37) is controlled to change the actuating force of the solenoid to F2 before the link 38 (or 39) abuts against an abutment stopper $P_{10}$ (or $P_{11}$). In this way, the actuating speed of the link in returning to the home position is decreased, thereby the impact noise can be suppressed.

Further, in the illustrated embodiment, while an example that the detecting means are independently provided in association with the respective links 38, 39 was explained, a single photosensor may be provided at an area where the links are overlapped (hatched area in FIG. 1) to detect the both links. In this case, since one of the detecting means can be omitted, cost can be reduced.

Incidentally, FIG. 6 is a front sectional view of the image forming apparatus A having the sorter according to the present invention. As shown in FIG. 6, the image forming apparatus includes cassettes 1, semi-circular pick-up rollers 2, a pair of registration rollers 3, a photosensitive drum 4, a fixing roller 5, a pair of discharge rollers 6, a flapper 7 and a discharge tray 8. An original feeding apparatus C is rested on the image forming apparatus. Incidentally, the entire image forming apparatus including the sorter may be called as "image forming apparatus" or "image forming apparatus with sorter".

Figure 3:
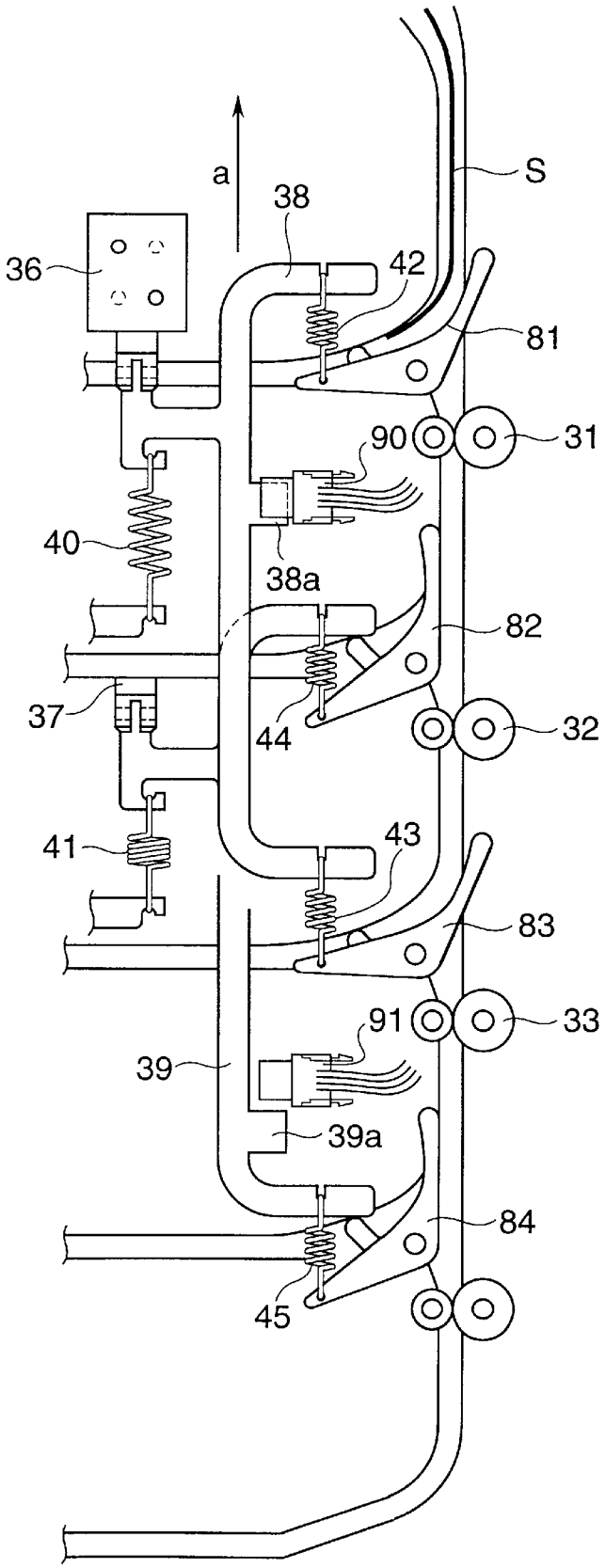
FIG. 3 is a view for explaining a condition that a sheet is discharged onto an upstream tray.
Figure 4:
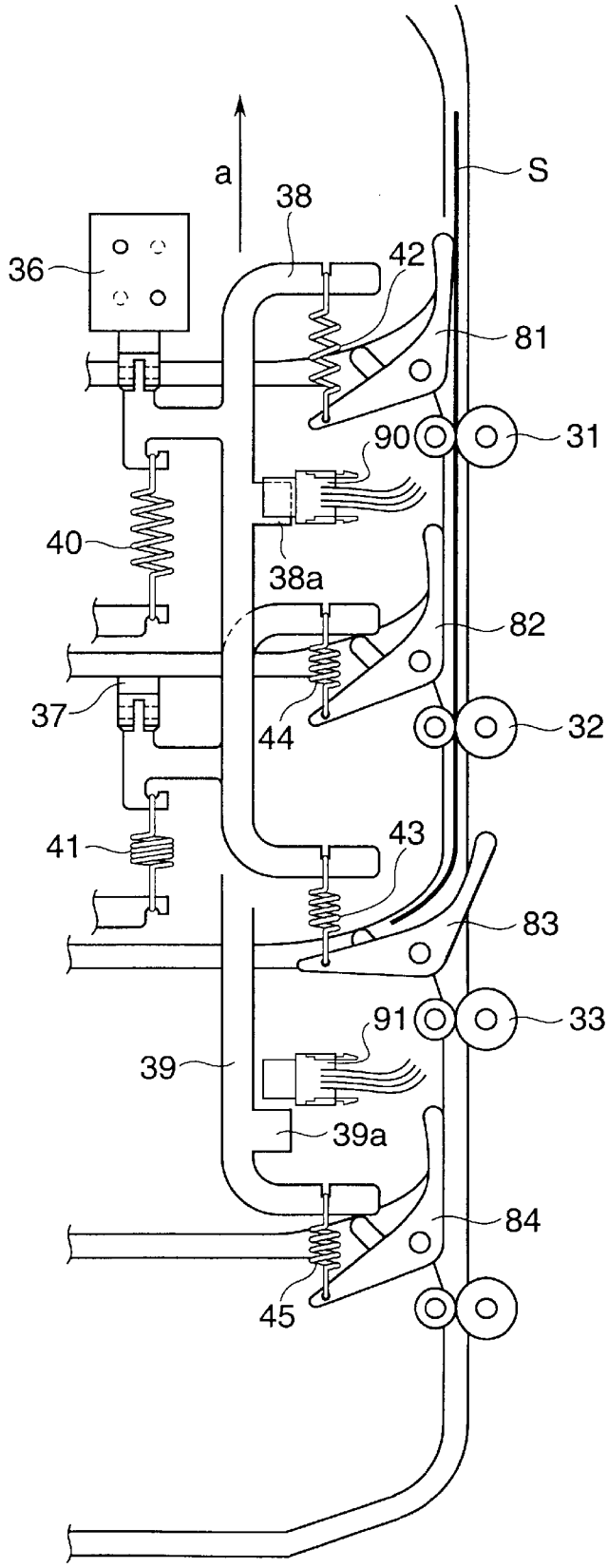
FIG. 4 is a view for explaining a condition that a sheet is discharged onto a downstream tray.

FIGS. 3 and 4 are views for explaining change in load depending on difference of the designated tray.

FIG. 3 shows a case where the sheet is discharged onto the upstream-most tray, and FIG. 4 shows a case where the sheet is discharged onto the downstream tray. In any cases, the solenoid (actuating means) 36 is turned ON at a predetermined timing to move the link 38 in the direction indicated by the arrow a, thereby oscillating the flappers 81, 83 via the elastic members 42, 43.

In this way, in any cases, the flapper not contributing to the sorting according to the designated tray is also oscillated. Here, lengths of the extension spring (elastic member) 42 being operated are compared between FIG. 3 and FIG. 4, the length in FIG. 4 (the sheet is discharged onto the downstream tray) is greater than the length in FIG. 3, so that a repulsive force acting on the solenoid is increased in FIG. 4. That is to say, when sheet is discharged onto the downstream tray, since the solenoid must be operated against the greater repulsive force of the elastic member 42, the solenoid 36 requires a greater attracting force.

Figure 5:
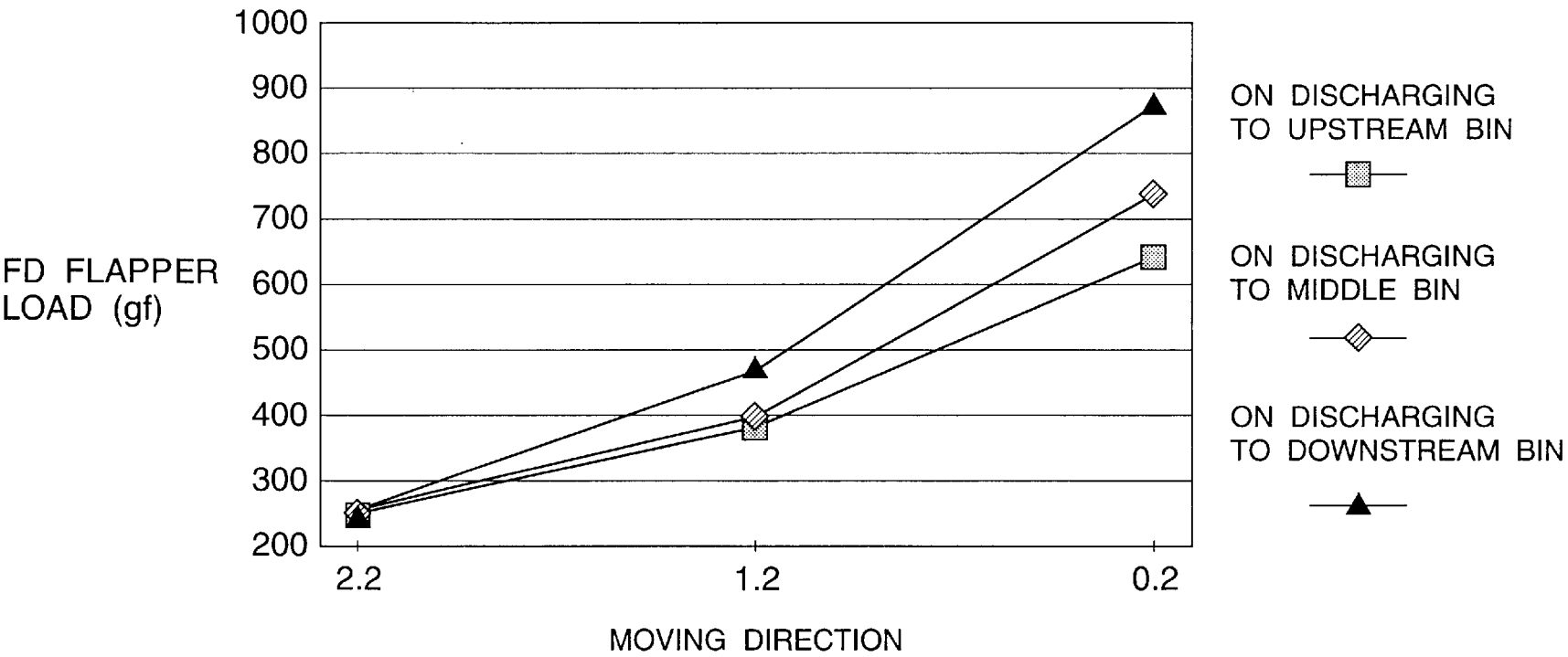
FIG. 5 is a view for explaining actuating forces required when three flappers are connected.

In the illustrated embodiment, while an example that two flappers are connected via the single connecting member was explained, the present invention is not limited to such an example. The above tendency becomes more noticeable as the number of flappers interconnected via the single connecting member is increased. FIG. 5 shows a result of measurement of attracting forces required for the solenoid when three flappers are interconnected via the single connecting member.

As can be seen from FIG. 5, there is a difference in required attracting forces, and a relationship between the forces is "upstream discharge<middle discharge<downstream discharge".

In the illustrated embodiment, in dependence upon the position of the designated discharge tray, the actuating force (attracting force) of the solenoid is changed.

More specifically, control is effected in such a manner that the actuating force becomes greater (by increasing electric current flowing through the solenoid) as the sheet is discharged onto the downstream tray.

In the illustrated embodiment, while an example that the actuating force is varied was explained, the present invention is not limited to such an example. For example, when a ratio of reduction of the actuating force changed after the detection of the detecting means becomes smaller as the sheet is discharged onto the downstream tray thereby to provide optimum relationship between the actuating force and the load, the impact noise can be further suppressed or minimized.

Next, a characteristic portion of the present invention will be described.

In the present invention, the flappers 81 to 84 are connected via the elastic members 42 to 45 to the links 38, 39 connected to the solenoids 36, 37 thereby to drive the plurality of flappers by the single solenoid. With this arrangement, if the opening/closing of the flappers is not completed within the predetermined time period, the sheet is discharged onto a tray other than the tray designated by the user. Therefore, new limitation is added after the oscillation of the flappers was started and until the oscillation of the flappers is completed.

Explaining more specifically, if the oscillating operation of the flappers occurs earlier than the predetermined time, the upstream flapper is opened so that the sheet being conveyed will be deflected by such upstream flapper to be discharged onto the tray other than the tray designated by the user.

Figure 7:
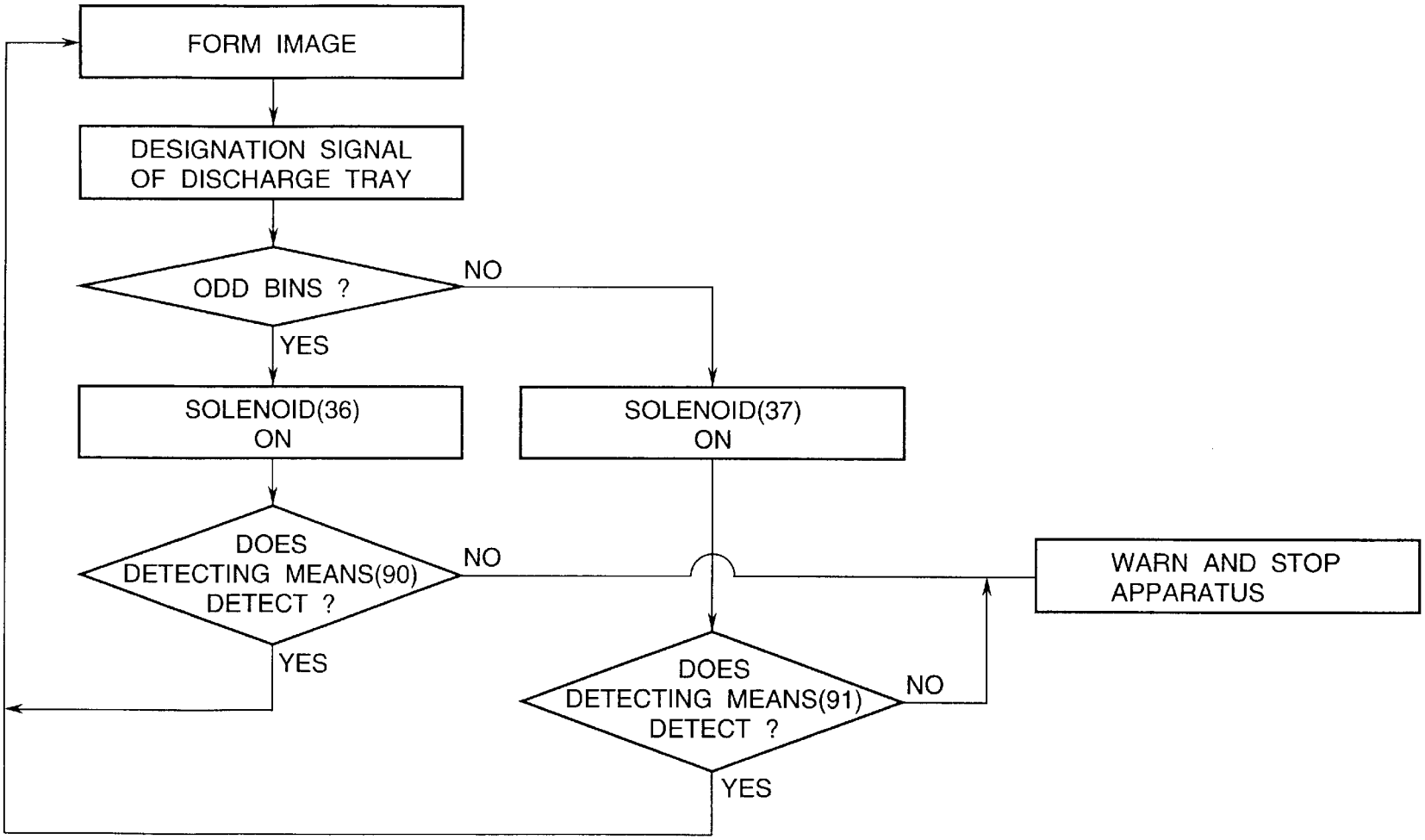
FIG. 7 is a flow chart showing a characteristic portion of the present invention.

However, in the illustrated embodiment of the present invention, the detecting means 90, 91 are provided in the course of trajectories of the connecting members managing the oscillating operations of the plurality of flappers, respectively. With this arrangement, when the detecting means 90 (or 91) is turned ON or OFF within a predetermined time period after input of the changing signal, it is considered that the flappers are operated correctly. If the movement of the connecting member cannot be detected within the predetermined time period, message (alarm or warning) can be sent to the user or the apparatus can be stopped so that the user can recognize the abnormality (fact that the sheet was discharged onto the tray other than the designated tray) (FIG. 7).

Further, reliability can be improved.

For example, if there is any unstable factor such as poor construction (minglement of low power solenoid, great resistance of oscillating movements of flappers or the like), when operated, the operating time of the connecting member is deviated from the correct one without fail. Thus, in the test running during the manufacture, so long as the operating time of each connecting member is checked, the poor operation can be found. Therefore, any poor apparatus can be prevented from putting on the market.

Since the article according to the present invention has no unstable factor such as poor parts (unstable factors were eliminated before the article is provided to the user), the article presented to the user has high reliability.

While only the opening of the flappers was explained, it is to be understood that the same judgement should be performed in the closing of the flappers.

[Second Embodiment]

Figure 8:
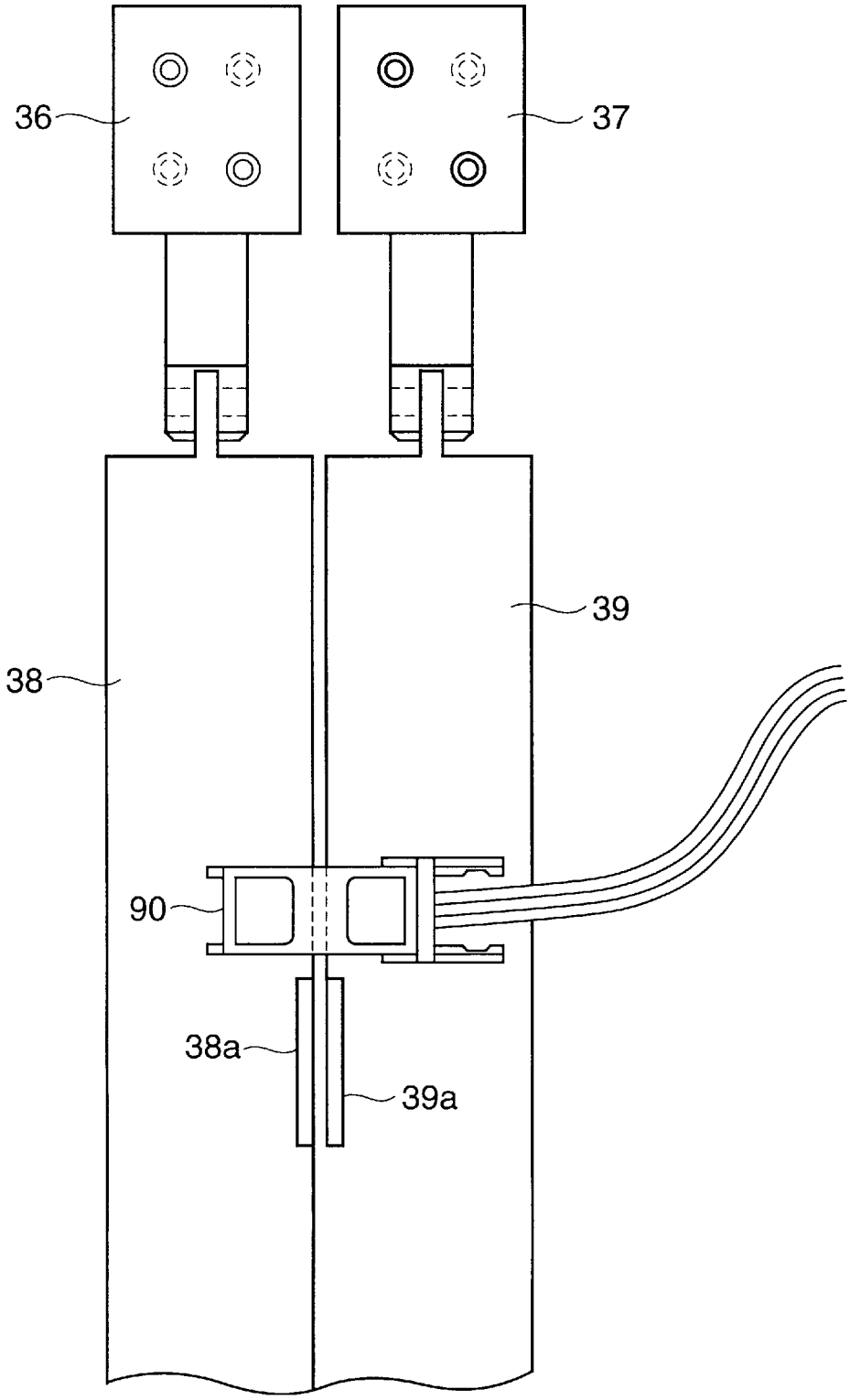
FIG. 8 is a view for explaining a second embodiment of the present invention.

In the above-mentioned embodiment, while an example that the detection means 90, 91 are independently provided with respect to the links 38, 39, respectively was explained, in a second embodiment of the present invention shown in FIG. 8, movements of the connecting members 38, 39 are detected by single detecting means.

Even when there are provided a plurality of connecting members, in the sheet sorting, since the plural connecting members 38, 39 are not operated simultaneously, as is in the second embodiment, two connecting members can be detected by the single detecting means.

With this arrangement, since the movements of the plurality of connecting members can be detected by the single detecting means, detecting cost can be minimized.

What is claimed is:

1. A sheet conveying apparatus comprising:

conveying path changing means, said conveying path changing means including:

oscillatable changing means for changing a conveying path;

electromotive means for generating an actuating force for oscillating said changing means; and detecting means for confirming a movement of said changing means wherein said electromotive means and said changing means are interconnected through connecting means, and said detecting means detects a movement of said connecting means to confirm movement of said changing means, wherein, when the movement of said changing means is not detected within a predetermined time period by said detecting means, alarm or warning is emitted, or alarm or warning is emitted and the apparatus is stopped.

2. A sheet conveying apparatus according to claim 1, wherein, after the movement of said changing means is confirmed by said detecting means, an actuating force of said electromotive means is decreased.

3. A sheet conveying apparatus according to claim 2, wherein the actuating force of said electromotive means is temporarily decreased, thereafter the actuating force is increased again.

4. A sheet conveying apparatus comprising:

conveying path changing means, said conveying path changing means including:

oscillatable changing means for changing a conveying path;

electromotive means for generating an actuating force for oscillating said changing means; and detecting means for confirming a movement of said changing means, wherein said electromotive means and said changing means are interconnected through connecting means, and said detecting means detects a movement of said connecting means to confirm the movement of said changing means, and wherein said changing means comprises a flapper and said electromotive means comprises a solenoid, and said electromotive means is connected to said connecting means via a first spring and said connecting means is connected to said flapper via a second spring, and said flapper is deterred at an oscillated position by a stopper, and, when the movement of said connecting means is not detected correctly by said connecting means, the alarm or warning is emitted.

5. A sheet conveying apparatus according to claim 4, wherein said flapper is disposed in each of a plurality of positions along a main conveying path in a conveying direction, and said plurality of flappers associate with said connecting means and the single solenoid thereby to be formed into a single unit as a whole.

6. A sheet conveying apparatus according to claim 5, wherein said unit is provided in each of a plurality of positions in the conveying direction so that a sheet can be conveyed to one of a plurality of branched paths.

7. A sheet conveying apparatus according to claim 6, wherein said flappers in each of said units are arranged alternately with said flappers in other units in the conveying direction, and said flappers are operated by the corresponding one of said units.

8. A sheet conveying apparatus according to claim 5, wherein said flappers are normally located at positions retracted from said main conveying path and are entered into said main conveying path simultaneously in response to an operation command.

9. A sheet conveying apparatus according to claim 8, wherein, when a sheet conveying path is changed by using an upstream flapper among said flappers, said electromotive means is operated before the sheet reaches said upstream flapper, and, when the sheet conveying path is changed by using a downstream flapper among said flappers, said electromotive means is operated while a leading end of the sheet is located between said upstream and downstream flappers.

10. A sheet conveying apparatus according to claim 9, wherein, an actuating force of said electromotive means when the sheet conveying path is changed by using the downstream entered flapper is selected to become greater than an actuating force of said electromotive means when the sheet conveying path is changed by using the upstream entered flapper.

11. A sheet conveying apparatus according to claim 10, wherein, after the movement of said connecting means is detected by said detecting means, the actuating force of said electromotive means is decreased.

12. A sheet conveying apparatus according to claim 11, wherein the actuating force of said electromotive means is temporarily decreased, thereafter the actuating force is increased again.

13. A sheet conveying apparatus comprising:

conveying path changing means, said conveying path changing means including:

a main conveying path for conveying a sheet;

a plurality of branched paths branched from said main conveying path;

a plurality of oscillating changing means for selecting between a changed position where the sheet is guided from said main conveying path to one of said branched paths and a retracted position permitting passage of the sheet;

a single electromotive means for oscillating said plurality of changing means;

single connecting means for connecting said electromotive means and said plurality of changing means; and detecting means for confirming a movement of said connecting means, wherein, when the movement of said connecting means is not detected correctly by said detecting means, alarm or warning is emitted, or alarm or warning is emitted and the apparatus is stopped.

14. A sheet conveying apparatus according to claim 13, further comprising: a plurality of said electromotive means; a plurality of said connecting means; and a plurality of said detecting means, wherein each of said detecting means detects a movement of each connecting means.

15. A sheet conveying apparatus according to claim 13, further comprising: a plurality of said electromotive means; and a plurality of said connecting means, wherein one of said detecting means detects the movement of said plurality of connecting means.

16. A sorter comprising a sheet conveying apparatus as recited in any one of claims 1–2 or 13–15.

17. A sorter comprising:

a main conveying path for conveying a sheet;

a plurality of branched paths branched from said main conveying path;

a plurality of bin trays opposed to said branched paths;

a plurality of flappers for selecting between to direct the sheet to one of said branched paths and to pass the sheet through said main conveying path;

a plunger;

a common connecting link for connecting said plunger and said flappers;

spring means disposed between said connecting link and said flappers;

a sensor for detecting a movement of said connecting link operated by an operation of said plunger;

control means for changing the flappers by operating said plunger at a predetermined timing to direct the sheet to a desired branched path; and control means for emitting alarm or warning, or emitting alarm or warning and stopping the sorter when correct movement of said connecting link is not detected by said sensor when said plunger is operated to the change the flappers via said connecting link.

18. A sorter according to claim 17, further comprising a plurality of sets each comprised of said plunger, said connecting link and said plurality of flappers, wherein said flappers in each set are arranged alternately with said flapper in other sets along said main conveying path.

19. A sorter according to claim 18, further comprising a plurality of said sensors each of which is opposed to a corresponding one of said connecting links.

20. A sorter according to claim 18, wherein said sensor is commonly used to detect movements of said plurality of connecting links.

21. A sheet conveying apparatus comprising:

conveying path changing means, said conveying path changing means including;

a main conveying path for conveying a sheet;

a plurality of branched paths branched from said main conveying path;

a plurality of oscillatable changing means for selecting between a changed position where the sheet is guided from said main conveying path to one of said branched paths and a retracted position permitting passage of the sheet;

electromotive means for oscillating said plurality of changing means;

connecting slider means for connecting said electromotive means and said plurality of changing means;

spring means disposed between said connecting slider means and said plurality of changing means; and detecting means for confirming a sliding movement of said connecting slider means.

22. A sheet conveying apparatus comprising:

conveying path changing means, said conveying path changing means including;

oscillatable changing means for changing a conveying path;

electromotive means for generating an actuating force for oscillating said changing means;

connecting slider means for connecting said oscillatable changing means;

spring means disposed between said connecting slider means and said oscillatable changing means; and detecting means for confirming a slide movement of said connecting slider means.

* * * * *

UNITED STATES PATENT AND TRADEMARK OFFICE

CERTIFICATE OF CORRECTION

PATENT NO. : 6,325,371 B1
DATED : December 4, 2001
INVENTOR(S) : Tomoyuki Araki et al.

It is certified that error appears in the above-identified patent and that said Letters Patent is hereby corrected as shown below:

Column 1,
Line 22, “are” should read -- is --.
Line 23, “image” should read -- images --.
Line 43, “a” (2nd occurrence) should be deleted.

Column 7,
Line 16, “means” should read -- means, --.
Lines 17-21, should be deleted.

Signed and Sealed this

Twenty-fourth Day of December, 2002

JAMES E. ROGAN
*Director of the United States Patent and Trademark Office*

UNITED STATES PATENT AND TRADEMARK OFFICE

CERTIFICATE OF CORRECTION

PATENT NO. : 6,325,371 B1
DATED : December 4, 2001
INVENTOR(S) : Tomoyuki Araki et al.

It is certified that error appears in the above-identified patent and that said Letters Patent is hereby corrected as shown below:

Column 7,
Line 54, "deterred" should read -- stopped --.

Signed and Sealed this

Twelfth Day of August, 2003

JAMES E. ROGAN
*Director of the United States Patent and Trademark Office*